US011732548B2

(12) United States Patent
Wang et al.

(10) Patent No.: US 11,732,548 B2
(45) Date of Patent: Aug. 22, 2023

(54) GROUND DOUBLE-HOLE COMBINED WATER INRUSH PREVENTION METHOD FOR OVERLYING STRATA MOVEMENT MONITORING AND BED SEPARATION WATER DRAINAGE

(71) Applicant: China University of Mining and Technology, Xuzhou (CN)

(72) Inventors: Xiaozhen Wang, Xuzhou (CN); Jianlin Xie, Xuzhou (CN); Weibing Zhu, Xuzhou (CN); Jialin Xu, Xuzhou (CN); Siyuan Yu, Xuzhou (CN)

(73) Assignee: China University of Mining and Technology, Xuzhou (CN)

( * ) Notice: Subject to any disclaimer, the term of this patent is extended or adjusted under 35 U.S.C. 154(b) by 0 days.

(21) Appl. No.: 17/716,731

(22) Filed: Apr. 8, 2022

(65) Prior Publication Data

US 2023/0075452 A1 Mar. 9, 2023

(30) Foreign Application Priority Data

Sep. 7, 2021 (CN) ..... 2021110423835

(51) Int. Cl.
*E21B 47/005* (2012.01)
*E21B 47/04* (2012.01)
*E21B 33/14* (2006.01)

(52) U.S. Cl.
CPC ..... *E21B 33/146* (2013.01); *E21B 47/005* (2020.05); *E21B 47/04* (2013.01)

(58) Field of Classification Search
CPC ..... E21B 43/13; E21B 47/04; E21B 47/005; E21B 2200/00
See application file for complete search history.

(56) References Cited

U.S. PATENT DOCUMENTS 4,349,228 A * 9/1982 Rohde ..... E21F 16/00 166/50
5,725,059 A * 3/1998 Kuckes ..... E21B 33/138 175/45
6,464,021 B1 * 10/2002 Edwards ..... E21B 47/04 175/45
2011/0278070 A1 * 11/2011 Hopkins ..... E21B 4/02 175/78
2012/0092960 A1 * 4/2012 Gaston ..... E21B 47/14 367/35
2015/0247385 A1 * 9/2015 Chen ..... E21B 43/2401 166/259

(Continued)

*Primary Examiner* — Shane Bomar

(57) ABSTRACT

The present invention relates to a ground double-hole combined water inrush prevention method for overlying strata movement monitoring and bed separation water drainage. By arranging a rock strata movement monitoring borehole and a bed separation water drainage borehole, interior movement information of an overlying stratum and bed separation generation timing fed back by strata movement monitoring performed inside are monitored; work on the bed separation water drainage borehole is guided by monitoring changes in arranged monitoring points; and through combination of the movement monitoring borehole and the bed separation water drainage borehole, the utilization rate of the bed separation water drainage borehole is effectively increased.

9 Claims, 5 Drawing Sheets

(56) References Cited

U.S. PATENT DOCUMENTS

| | | | | |
|---|---|---|---|---|
| 2016/0177676 | A1* | 6/2016 | Lynch | E21B 41/0035 405/285 |
| 2017/0044887 | A1* | 2/2017 | Coetzee | E21B 7/046 |
| 2020/0194140 | A1* | 6/2020 | Payer | G21F 5/015 |
| 2020/0270977 | A1* | 8/2020 | Kraynek | E21B 43/26 |
| 2021/0348508 | A1* | 11/2021 | Greci | E21B 47/20 |
| 2023/0133939 | A1* | 5/2023 | Fouda | E21B 47/135 324/324 |

* cited by examiner

GROUND DOUBLE-HOLE COMBINED WATER INRUSH PREVENTION METHOD FOR OVERLYING STRATA MOVEMENT MONITORING AND BED SEPARATION WATER DRAINAGE

TECHNICAL FIELD

The present invention relates to a ground double-hole combined water inrush prevention method, in particular to a ground double-hole combined water inrush prevention method for overlying strata movement monitoring and bed separation water drainage, which is suitable for treatment of overlying bed separation flood after mining in a water-rich stratum.

BACKGROUND

Coal seam mining can cause cracks in different layers of the overlying strata. When the adjacent upper and lower strata in the overlying strata are deformed asynchronously due to their thickness and strength differences, there may be transverse cracks between the upper and lower strata, that is, a so-called bed separation. When the overlying rock stratum of the bed separation is a water-rich rock layer, water accumulation in a bed separation space is caused. With continuous advancement of the working face and the increase of time, the water content and water pressure in the enclosed space are continuously accumulated. When certain conditions are satisfied, it will cause the fissure and instability of the rock stratum under a bed separation water body, so that the bed separation water can quickly break into the working face through a diversion fissure zone. At the same time, the instability of the overlying strata structure will cause violent pressure and support crushing on the working face. The bed separation water inrush is characterized in that the total volume is small, but the omen before water inrush is not obvious. When the water body suddenly breaks out, the instantaneous water volume is huge and the coming force is fierce, which is often easy to cause disasters. Therefore, avoiding sudden water inrush caused by the accumulation of the bed separation water is a key to prevent such disasters.

In the past, the bed separation water was drained by underground upward drilling, but the drilling construction distance is long, the closure is easily destroyed to lose a water release function. There are also methods to drain the water to the underground through ground surface drilling, but it is often necessary to simply judge the development situation of the bed separation in the hole according to the experience of air suction at the orifice. When the water volume in the hole is large, it is often difficult to perceive air suction. Therefore, information on formation of the bed separation is not accurate, so the good opportunity of drilling a through hole, water release and hole sealing cannot be well grasped, sometimes resulting in damage of the borehole with movement so as not to be known, and therefore measures cannot be taken in time. The present invention provides a ground double-hole combined water inrush prevention method for overlying strata movement monitoring and bed separation water drainage. The information on movement of the strata, especially generation of the bed separation is grasped by monitoring the movement information of the strata in real time, drilling or hole penetration measures are taken to determine the communication length between a water release hole and a fissure zone according to the development situation of the overlying bed separation in the advancing process to control a water release volume and achieve the purpose of water release without inducing water inrush. Therefore, the bed separation water drainage is more scientific, and the utilization rate of drilling is increased.

SUMMARY

Aiming at the defects in the prior art, the present invention provides a ground double-hole combined water inrush prevention method for overlying strata movement monitoring and bed separation water drainage. Through coordinated monitoring and detection of two holes, the timing and the construction depth of a bed separation water drainage borehole during drainage of bed separation water can be fully combined with the characteristics of rock movement and bed separation development, which can avoid an error or even misjudgment caused by the original use of orifice air suction to judge whether a through hole is needed or not, achieve accurate control, and expand the application scope of strata movement monitoring in the borehole at the same time.

In order to realize the above technical objective, the ground double-hole combined water inrush prevention method for overlying strata movement monitoring and bed separation water drainage of the present invention comprises the following steps:

a. a rock strata movement monitoring borehole and a bed separation water drainage borehole are arranged along the central axis of a working face in a trending direction according to the mining width of the working face on the ground surface to be mined, wherein an interval between the rock strata movement monitoring borehole and the bed separation water drainage borehole is S.

b. A bottom interface of a local aquifer is acquired by geological drilling, and a development height $H_d$ of a diversion fissure zone is determined according to the mining conditions, or according to actually measured results in a same area; the rock strata movement monitoring borehole is constructed, and then the bed separation water drainage borehole is constructed, wherein the drilling depth of the rock strata movement monitoring borehole is a buried depth $H_m$ of a top interface of a caving zone in a stratum, and the construction depth of the bed separation water drainage borehole is 20 m above the buried depth $H_{dj}$ of the top interface of the diversion fissure zone, that is, the buried depth H of a coal seam subtracts the development height $H_d$ of the diversion fissure zone, and then subtracts 20 m.

c. The distribution positions of n monitoring points are set according to the stratum information obtained in advance, so as to correspond to the movement states of strata at different depths, wherein the monitoring points set above the bottom boundary of the aquifer are upper aquifer monitoring points, the monitoring points between the bottom interface of the aquifer and the diversion fissure zone are the bed separation development monitoring points, the diversion fissure zone does not directly communicate with the aquifer, and the monitoring points below the top interface of the diversion fissure zone are lower monitoring points, a cable with n monitoring points arranged at intervals is put at the deepest depth $H_m$ inside the rock strata movement monitoring borehole by utilizing a hollow grouting drill pipe, and accurate positions of monitoring points are determined by utilizing a drill pipe depth, so that the n monitoring points are distributed at different borehole depths to monitor the movement states of strata at different depths.

d. Cement slurry full hole sealing is performed from bottom to top starting from the most bottom of the rock strata movement monitoring borehole by utilizing a hollow grouting drill pipe until cement slurry rises to the borehole orifice, so as to fix the positions of the n monitoring points, then a cable connecting the monitoring points is connected with an orifice collector set on the ground surface, and feedback information of the n monitoring points is read through the orifice collector to monitor the movement state of each stratum in the mining process of the working face.

e. When the bed separation development monitoring point in the rock strata movement monitoring borehole starts to relatively move, the bed separation water drainage borehole is continued to be constructed to penetrate through a bed separation water accumulation area at the lower part of the aquifer to the buried depth $H_{dj}$ of the top interface of the diversion fissure zone, so that the bed separation water drainage borehole communicates with the mined diversion fissure zone, and the water is preliminarily released to a lower rock fissure zone and a caving area through the fissure; when a movement speed difference of the stratum where the bed separation development monitoring points are located exceeds 5 mm/d, the bed separation water drainage borehole continues to be drilled from the top interface of the diversion fissure zone to the deeper part of the fissure zone until a half of the thickness of the diversion fissure zone, and the specific depth is $H_{dj}+(H_d-H_k)\div 2$;

when a relative movement speed of the stratum obtained from the bed separation development monitoring points in the rock strata movement monitoring borehole exceeds 10 mm/d, the bed separation water drainage borehole continues to be drilled from the middle layer of the fissure zone to the deeper part until the bottom of the fissure zone, i.e. the top interface of the caving zone with a depth $H_m$; and during the period, the working face continues to be mined, through the above steps, according to the development situation of the stratum movement bed separation, the bed separation water is drained to a mined working face or a goaf area behind the working face in a staged and controlled manner and then drained by utilizing a drainage device.

f. As the working face advances, when a relative rock stratum movement speed obtained by the bed separation development monitoring points in the rock strata movement monitoring borehole does not change within 2-3 days, the relative rock stratum movement speed is considered to be in a temporary stable state, and then full borehole penetration is performed by the orifice of the bed separation water drainage borehole until the fissure zone is located on the vertically upward middle layer, so as to ensure smoothness of the bed separation water drainage borehole and play the role in continuous water release.

g. As the working face advances, according to the monitoring information inside the rock strata movement borehole, when the relative movement speed of the rock stratum obtained by the bed separation development monitoring points in the rock strata movement monitoring borehole is less than 5 mm/d and the movement difference between the top interface of the diversion fissure zone and the bottom boundary of the aquifer is continuously decreased within the next 5 days, the rock stratum at the lower part of the aquifer begins to be closed, and the bed separation disappears gradually; and then, the bed separation water drainage borehole is made to penetrate through the bed separation water drainage borehole to enable the bed separation water drainage borehole to be unobstructed, and preparation is made for later hole sealing.

h. When the relative movement speed of the rock stratum obtained by the bed separation development monitoring points in the rock strata movement monitoring borehole is less than 1 mm/d, the cement slurry full hole sealing is performed on the bed separation water drainage borehole.

Further, the coal seam thickness M and coal seam buried depth $H_c$ around the rock strata movement monitoring borehole, the buried depth $H_s$ of the bottom interface of the water-rich stratum mainly derived from the bed separation water to be prevented and lithology information of overlying rocks are acquired, so as to determine the development height $H_d$ of the diversion fissure zone and the caving zone height $H_k$ of the stratum around the rock strata movement monitoring borehole; wherein the buried depth $H_{dj}$ of the top boundary of the diversion fissure zone is obtained by subtracting the development height $H_d$ of the diversion fissure zone from the buried depth $H_c$ of the coal seam, and the buried depth $H_m$ of the top interface of the caving zone is obtained by subtracting the height $H_k$ of the caving zone from the buried depth $H_c$ of the coal seam, i.e. the construction depth of the rock strata movement monitoring borehole; that is, the strata movement monitoring points are set inside the rock strata movement monitoring borehole, a final construction depth of the bed separation water drainage borehole should reach the bottom interface of the diversion fissure zone, i.e. the buried depth $H_m$ of the top interface of the caving zone.

Further, the construction diameter of the strata movement monitoring borehole needs to meet the following conditions: the borehole diameter $D_c$ required by strata movement monitoring is determined by the outer diameter m of the monitoring cable m and the maximum outer diameter d of the hollow grouting drill pipe; $D_c$ is greater than or equal to the maximum outer diameter d of the hollow grouting drill pipe used for hole sealing multiplied by 1.5 times plus the total number n of strata movement monitoring points multiplied by the outer diameter m of a single monitoring cable m and multiplied by 60%, i.e. $D_c \geq d\times 1.5+n\times m\times 60\%$; and the diameter of the bed separation water drainage borehole is 120-150 mm.

Further, the interval S is greater than 10 m and less than or equal to 20 m, the bed separation water drainage borehole lags behind the rock strata movement monitoring borehole in the advancing direction of the working face.

Further, when the rock strata movement monitoring borehole and the bed separation water drainage borehole are constructed, the borehole slanting correction is conducted once every 50 m, and a borehole slanting is controlled not to be greater than 1 m every 100 m.

Further, the rock strata movement monitoring points are set inside the boreholes, and at least 2 monitoring points need to be set within the diversion fissure zone of the overlying strata, and at least 2 monitoring points are set between the top interface of the diversion fissure zone and the position above the bottom interface of the water-rich stratum to be drained; and the number n of the strata movement monitoring points should be at least greater than 5, and the location shall ensure the number of points in claim 4.

Further, the movement speed difference of the monitoring point is calculated by dividing the movement difference of the monitoring point in unit time by the unit time, and the unit time generally selects half a day or 1 day.

Further, the relative movement speed of the bed separation development monitoring point in the rock strata movement monitoring borehole is temporarily stable, which means that the movement speed does not change by more than 5 mm/d within 1 day temporarily.

Further, the cement slurry used for borehole sealing is formed by mixing loose dry cement with water, the loose dry cement is ordinary Portland cement with a strength grade of 42.5R, and a water cement ratio in the cement slurry is 0.6:1.

The present invention has the beneficial effects: in the method, by monitoring the movement information of the rock stratum in real time, formation movement, especially the generation information of the bed separation, is grasped; drilling or hole penetrating measures are taken in time, and the communication length between drainage borehole and fissure zone is determined according to the development situation of the overlying bed separation in the advancing process to control the water release amount and achieve water release without sudden increase of water volume, so that the water inrush disaster caused by sudden gushing of bed separation is prevented, the bed separation water drainage is more scientific, and the utilization rate of the borehole is increased.

BRIEF DESCRIPTION OF THE DRAWINGS

FIG. 2 (*b*) is an enlarged schematic diagram of monitoring point installation of stratum movement monitoring holes of the ground double-hole combined water inrush prevention method for overlying strata movement monitoring and bed separation water drainage according to the present invention;

FIG. 3 (*b*) is a schematic diagram of a bed separation water drainage borehole before drainage in the staged drainage process of the bed separation water drainage borehole according to the present invention;

FIG. 3 (*c*) is a schematic diagram of a bed separation water drainage borehole penetrating into the middle of the diversion fissure zone in the staged drainage process of the bed separation water drainage borehole according to the present invention;

FIG. 3 (*d*) is a schematic diagram of a bed separation water drainage borehole penetrating into the bottom interface of the diversion fissure zone in the staged drainage process of the bed separation water drainage borehole according to the present invention;

FIG. 3 (*e*) is a schematic diagram of hole sealing after a bed separation water drainage borehole completes water drainage in the staged drainage process of the bed separation water drainage borehole according to the present invention.

In the figure: 1—rock strata movement monitoring borehole; 2—bed separation water drainage borehole; 3—working face cutting hole; 4—working face roadway a; 5—working face roadway b; 6—water-rich stratum; 7—diversion fissure zone; 8—caving zone; 9—fissure zone; 10—lower monitoring point; 11—upper monitoring point of aquifer; 12—orifice collector; 13—overlying bed separation water accumulation area; 14—hollow grouting drill pipe; 15—bed separation development monitoring point.

DETAILED DESCRIPTION

The specific borehole examples will be further described in combination with drawings.

Figure 1:
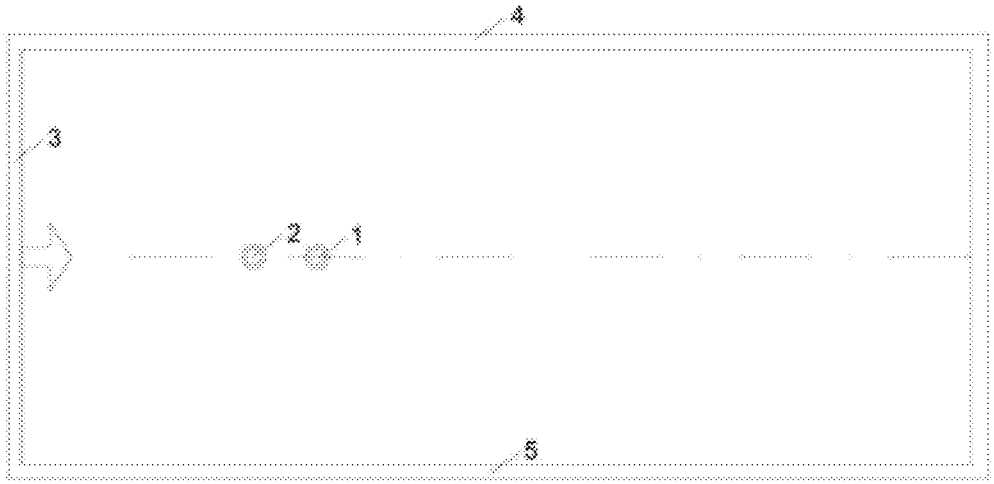
FIG. 1 is a top view of a ground double-hole combined water inrush prevention method for overlying strata movement monitoring and bed separation water drainage according to the present invention.
Figure 2:
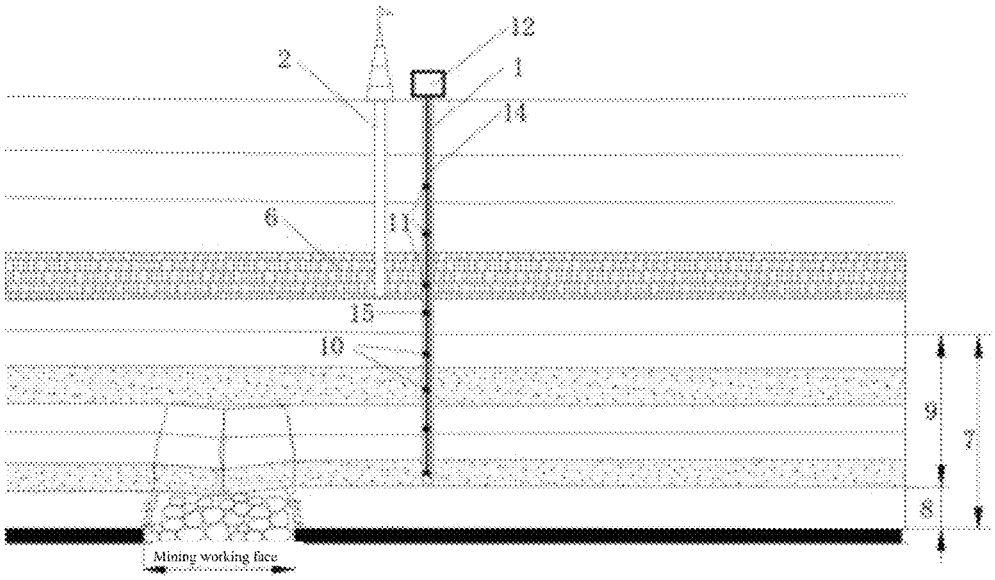
FIG. 2 (*a*) is a global schematic diagram of monitoring point installation of stratum movement monitoring holes of the ground double-hole combined water inrush prevention method for overlying strata movement monitoring and bed separation water drainage according to the present invention.
Figure 2:
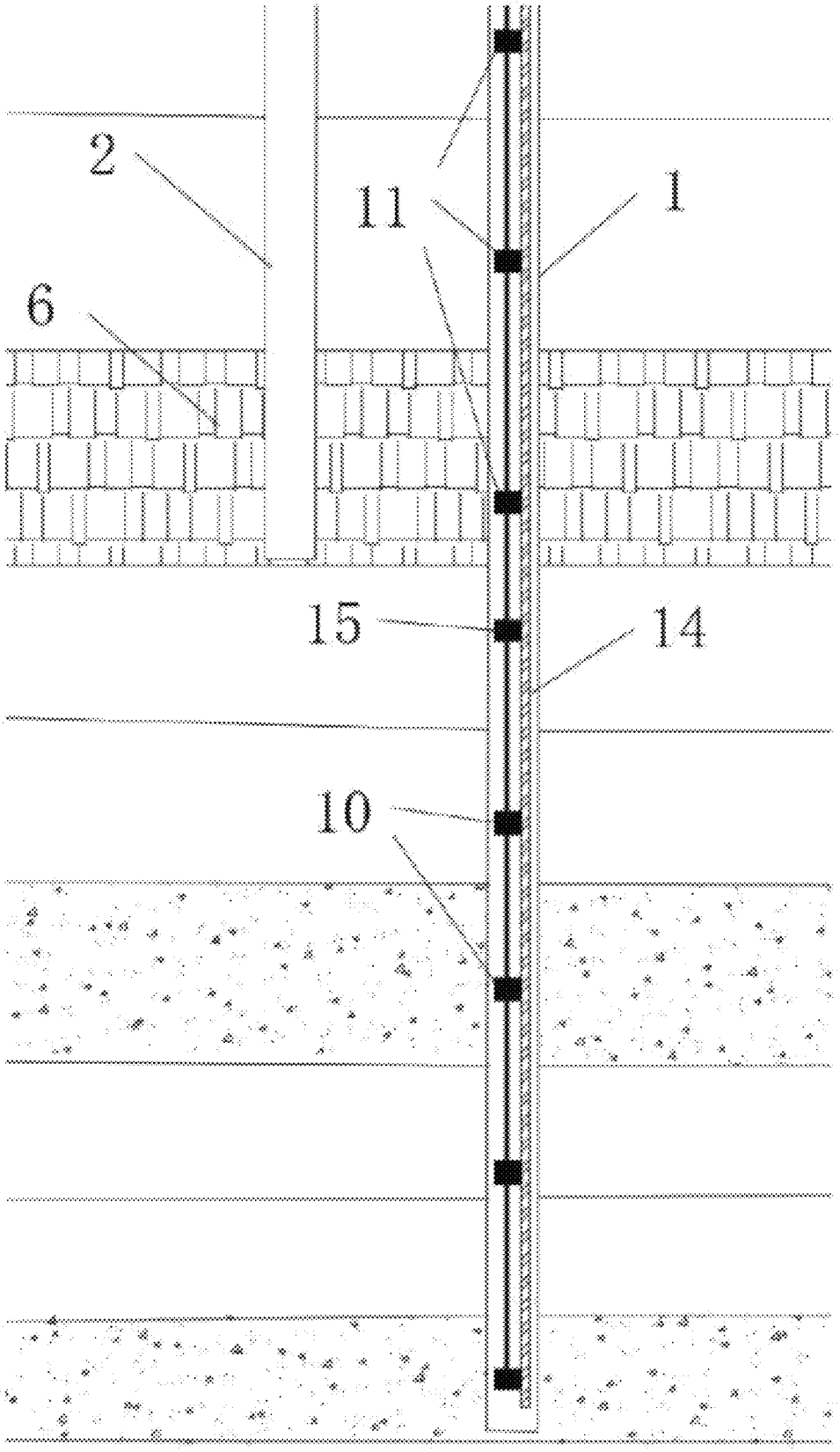
Figure 3:
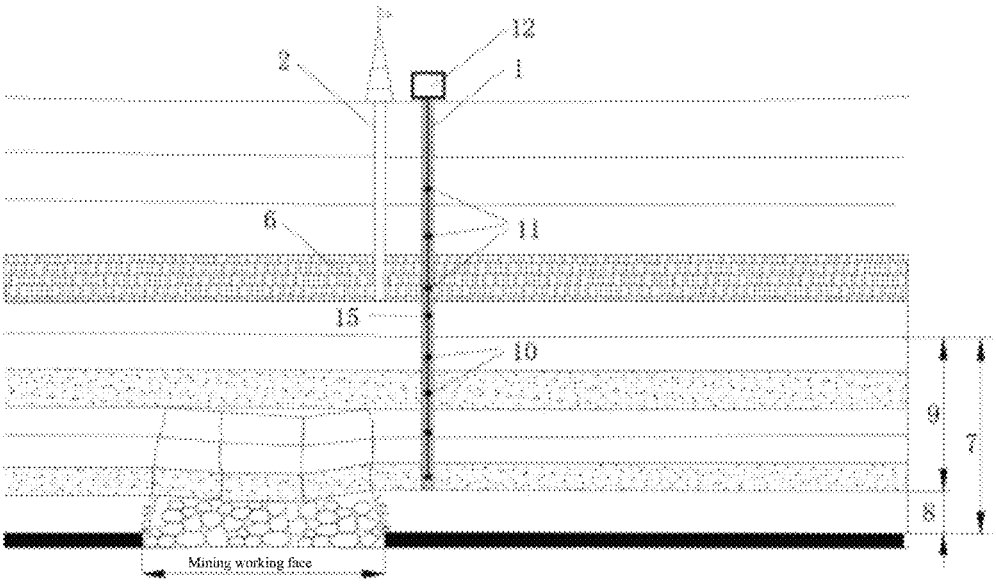
FIG. 3 (*a*) is a schematic diagram of a bed separation water drainage borehole before drainage in the staged drainage process of the bed separation water drainage borehole according to the present invention.
Figure 3:
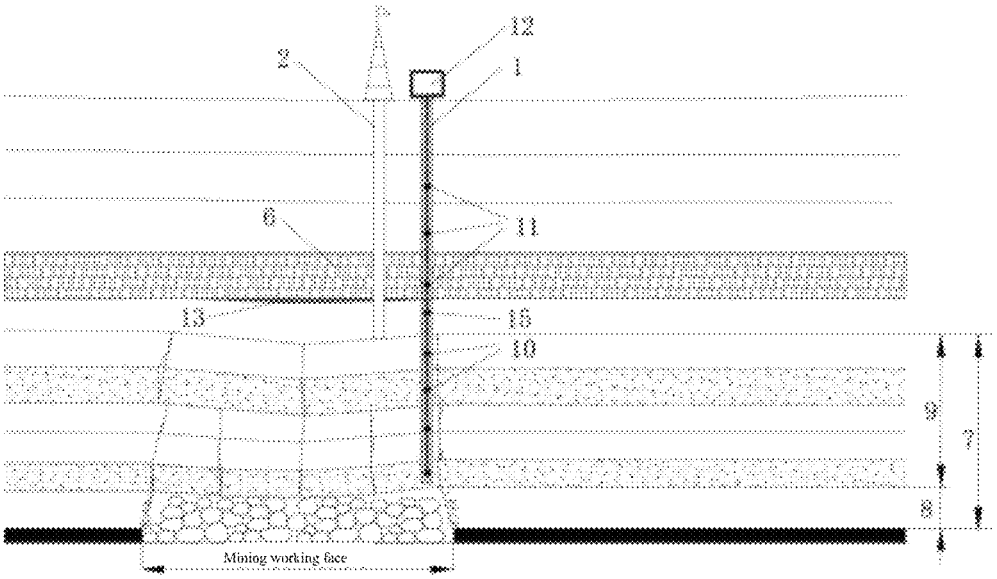
Figure 3:
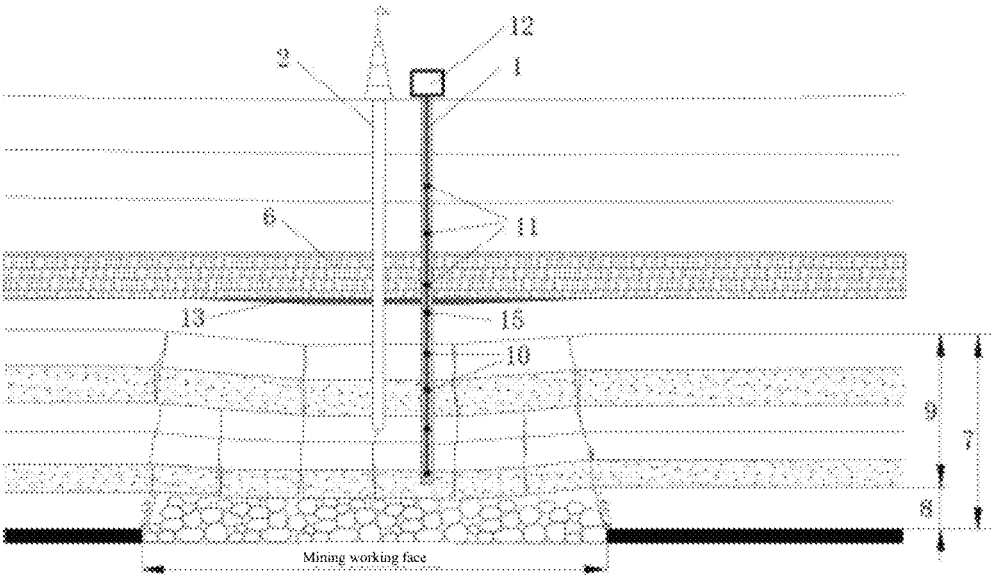
Figure 3:
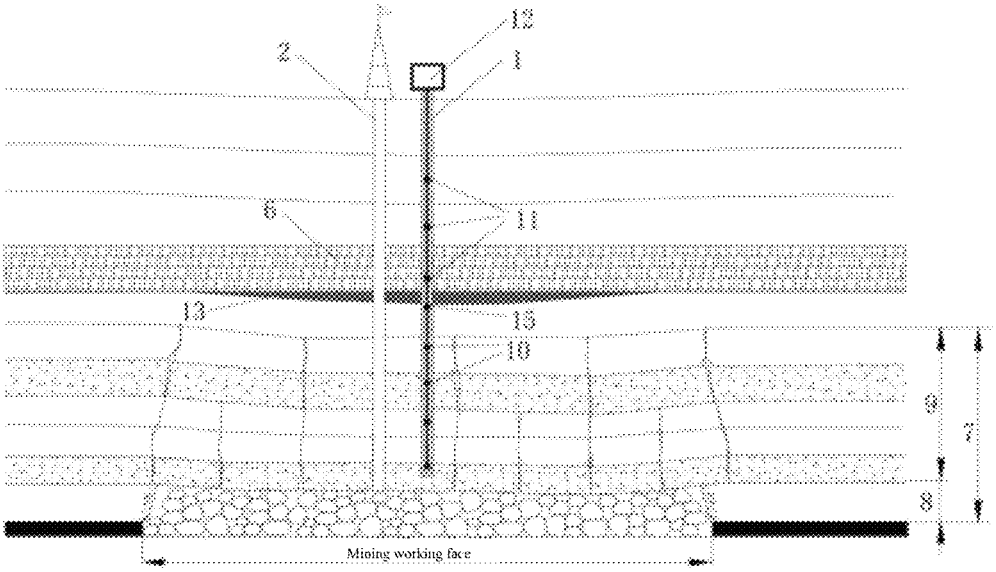
Figure 3:
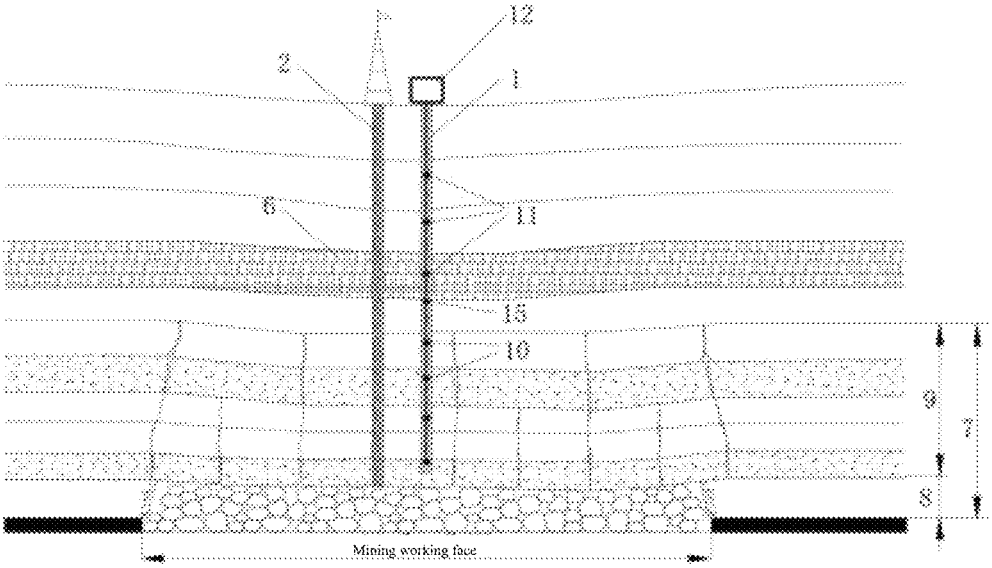

A ground double-hole combined water inrush prevention method for overlying strata movement monitoring and bed separation water drainage of the present invention comprises the following steps:

a. as shown in FIG. 1, the working face is determined by a working face cutting hole 3, a working face roadway a4 and a working face roadway b5 on the ground surface to be mined according to a mining width of a working face, a rock strata movement monitoring borehole 1 and a bed separation water drainage borehole 2 are arranged along the central axis of the working face in a trending direction, and an interval between the rock strata movement monitoring borehole 1 and the bed separation water drainage borehole 2 is S which is greater than 10 m and less than or equal to 20 m; and the bed separation water drainage borehole 2 lags behind the rock strata movement monitoring borehole 1 in the advancing direction of the working face.

b. As shown in FIG. 2(*a*) and FIG. 2(*b*), a bottom interface of a local aquifer 6 is acquired by geological drilling, and a development height $H_d$ of a diversion fissure zone 7 is determined according to the mining conditions, or according to actually measured results in a same area; the rock strata movement monitoring borehole 1 is constructed, and then the bed separation water drainage borehole 2 is constructed; when the rock strata movement monitoring borehole 1 and the bed separation water drainage borehole 2 are constructed, the borehole slanting correction is conducted once every 50 m, and a borehole slanting is controlled not to be greater than 1 m every 100 m, wherein the drilling depth of the rock strata movement monitoring borehole 1 is a buried depth $H_m$ of a top interface of a caving zone in a stratum, and the construction depth of the bed separation water drainage borehole 2 is 20 m above the buried depth $H_{dj}$ of the top interface of the diversion fissure zone, i.e. the buried depth $H_c$ of the coal seam subtracts the development height $H_d$ of the diversion fissure zone, and then subtracts 20 m; the coal seam thickness M and coal seam buried depth $H_c$ around the rock strata movement monitoring borehole 1, the buried depth $H_s$ of the bottom interface of the water-rich bed separation mainly derived from the bed separation water to be prevented and lithology information of the overlying rock are acquired, so as to determine the development height $H_d$ of the diversion fissure zone 7 and the caving zone height $H_k$ of the stratum around the rock strata movement monitoring borehole 1, wherein the buried depth $H_{dj}$ of the top boundary of the diversion fissure zone 7 is obtained by subtracting the development height $H_d$ of the diversion fissure zone 7 from the buried depth $H_c$ of the coal seam, and the buried depth $H_m$ of the top interface of the caving zone is obtained by subtracting the height $H_k$ of the caving zone 8 from the buried depth $H_c$ of the coal seam, i.e. the construction depth of the rock strata movement monitoring borehole; that is, the strata movement monitoring points are set inside the rock strata movement monitoring borehole 1, and a final construction depth of the bed separation water drainage borehole 2 should reach the bottom interface of the diversion fissure zone, i.e. the buried depth $H_m$ of the top interface of the caving zone 6. The construction diameter of the strata movement monitoring borehole 1 needs to satisfy the following conditions: the borehole diameter $D_c$ required by strata movement monitoring is determined by the outer diameter m of the monitoring cable m and the maximum outer diameter d of the hollow grouting drill pipe, $D_c$ is greater than or equal to the maximum outer diameter d of the hollow grouting drill pipe 14 used for hole sealing multiplied by 1.5 times plus the total number n of strata movement monitoring points multiplied by the outer diameter m of a single monitoring cable m and multiplied by 60%, i.e. $D_c \geq d \times 1.5 + n \times m \times 60\%$, and the diameter of the bed separation water drainage borehole is 120-150 mm.

c. The distribution positions of n monitoring points are set according to the stratum information obtained in advance, so as to correspond to the movement state of strata at different depths, wherein the monitoring points set above the bottom boundary of the bed separation are upper bed separation monitoring points 11, the monitoring point between the bottom interface of the bed separation and the diversion fissure zone 7 is the bed separation development monitoring point 15, the diversion fissure zone 7 does not directly communicate with the aquifer 6, and the monitoring points below the top interface of the diversion fissure zone 7 are lower monitoring points 10, a cable with n monitoring points arranged at intervals is put at the deepest monitoring depth $H_m$ inside the rock strata movement monitoring borehole 1 by utilizing a hollow grouting drill pipe 14, and accurate positions of monitoring points are determined by utilizing the drill pipe depth, so that the n monitoring points are distributed at different borehole depths to monitor the movement states of strata at different depths; the rock strata movement monitoring points are set inside the boreholes, at least 2 monitoring points need to be set within the diversion fissure zone of the overlying strata, and at least 2 monitoring points are set between the top interface of the diversion fissure zone and the position above the bottom interface of the water-rich stratum to be drained; and the number n of the strata movement monitoring points should be at least greater than 5, and the location shall ensure the number of points in claim 4.

d. Cement slurry full hole sealing is performed from bottom to top starting from the most bottom of rock strata movement monitoring borehole 1 by utilizing the hollow grouting drill pipe until cement slurry rises to the borehole orifice, so as to fix the positions of n monitoring points, then the cable connecting the monitoring points is connected with an orifice collector 12 set on the ground surface, and feedback information of the n monitoring points is read through the orifice collector to monitor the movement state of each stratum in the mining process of the working face.

e. When the bed separation development monitoring point 15 in the rock strata movement monitoring borehole 1 starts to relatively move, a movement speed difference of the monitoring point is calculated by dividing the movement difference of the monitoring point in unit time by the unit time, and the unit time generally selects half a day or 1 day; the bed separation water drainage borehole 2 is continued to be constructed to penetrate through a bed separation accumulation area at the lower part of the aquifer to the buried depth $H_{dj}$ of the top interface of the diversion fissure zone, so that the bed separation water drainage borehole 2 communicates with the mined diversion fissure zone 7, and water is preliminarily released to a lower rock fissure zone 9 and a caving area 8 through the fissure; when the movement speed difference of the stratum where the bed separation development monitoring point 15 is located exceeds 5 mm/d, the bed separation water drainage borehole 2 continues to be drilled from the top interface of the diversion fissure zone 7 to the deeper part of the fissure zone 9 until a half of the thickness of the diversion fissure zone 7, and the specific depth is $H_{dj}+(H_d-H_k)\div 2$;

when the relative movement speed of the stratum obtained from the bed separation development monitoring point 15 in the rock strata movement monitoring borehole 1 exceeds 10 mm/d, the bed separation water drainage borehole 2 continues to be drilled from the middle layer of the fissure zone 9 to the deeper part until the bottom of the fissure zone 9, i.e. the top interface of the caving zone 8 with a depth $H_m$; and during the period, the working face continues to be mined, through the above steps, according to the development situation of the stratum movement bed separation, the bed separation water is drained to a working face or a goaf area behind the working face in a staged and controlled manner and then drained by utilizing a drainage device.

f. Before data change of strata movement monitoring points, the bed separation water drainage borehole 2 is constructed to the depth $H_1$, which is 20 m above the buried depth $H_{dj}$ of the top interface of the diversion fissure zone, that is, the buried depth $H_c$ of the coal seam subtracts the development height $H_d$ of the diversion fissure zone and then subtracts 20 m to obtain 500.6 m, and the current state of the bed separation water drainage borehole before drainage is as shown in FIG. 3 (*a*). When the monitoring points inside the rock strata movement monitoring borehole 1 located between the top interface of the diversion fissure zone and the bottom interface of the bed separation move relatively, the bed separation water drainage borehole 2 is constructed from the depth of 500.6 m through the overlying bed separation water accumulation area 13 at the lower part of the bed separation to the buried depth of the top interface of the diversion fissure zone of 520.6 m, so as to connect the borehole with the mined diversion fissure zone 7, and the water is preliminarily released to the lower rock fissure zone and caving area, which shows a state that the bed separation water drainage borehole goes deep into the top interface of the diversion fissure zone, as shown in FIG. 3(*b*); when the movement speed difference of the monitoring points located between the top interface of the diversion fissure zone and the bottom boundary of the water-rich stratum inside the rock strata movement monitoring borehole 1 exceeds 5 mm/d, the bed separation water drainage borehole 2 is constructed from the buried depth of the top interface of the diversion fissure zone 520.6 m to the middle layer of the diversion fissure zone 7, and the specific depth is 542.8 m, which show a state that the bed separation water drainage borehole goes deep into the middle part of the diversion fissure zone, as shown in FIG. 3 (*c*); when the relative movement speed of the monitoring point inside the rock strata movement monitoring borehole 1 between the top interface of the diversion fissure zone and the bottom boundary of the bed separation exceeds 10 mm/d, the bed separation water drainage borehole 2 is constructed from 542.8 m to the bottom of the diversion fissure zone 7, i.e. the top interface of the caving zone with a depth of 565 m, which show a state that the bed separation water drainage borehole goes deep into the bottom interface of the diversion fissure zone, as shown in FIG. 3 (*d*); and in the above process, the working face is continuously mined. Through the above steps, the bed separation water is drained to the underground in stages. From FIG. 3 (*b*)-FIG. 3 (*d*), with the expansion of the working face, the area and the thickness of the overlying bed separation water accumulation area 13 are increased.

g. After the bed separation water drainage borehole 2 is drilled into a designed depth, as the working face advances, when the relative movement speed of the monitoring point located between the top interface of the diversion fissure zone and the bottom interface of the bed separation is temporarily stable, a through hole may be drilled so as to ensure smoothness of water release; and the relative movement speed of the bed separation development monitoring point 15 in the rock strata movement monitoring borehole 1 is temporarily stable, which means that the movement speed does not change by more than 5 mm/d within 1 day temporarily.

h. In the process of advancing the working face, according to the monitoring information inside the rock strata movement borehole 1, when the relative movement speeds of the monitoring points between the top interface of the diversion fissure zone and the bottom interface of the bed separation in the rock strata movement monitoring borehole 1 are all less than 5 mm/d, and the movement difference between the top interface of the diversion fissure zone and the bottom boundary of the bed separation is continuously decreased within the next 5 days, the rock stratum at the lower part of the aquifer begins to be closed and the bed separation disappears gradually. In the process of developing from the state as shown in FIG. 3 (*e*) to the state as shown in FIG. 3 (*d*), drill penetration can be performed on the bed separation water drainage borehole 2, so that drilling is smooth.

i. When the bed separation water drainage borehole is sealed after drainage as shown in FIG. 3(*e*) after the relative movement speeds of the monitoring points between the top interface of the diversion fissure zone and the bottom interface of the bed separation in the rock strata movement monitoring borehole 1 are less than 1 mm/d, cement slurry full hole sealing is performed, and the cement slurry used for borehole sealing is formed by mixing loose dry cement with water, wherein the loose dry cement is ordinary Portland cement with a strength grade of 42.5R, and a water cement ratio in the cement slurry is 0.6:1.

What is claimed is:

1. A ground double-hole combined water inrush prevention method for overlying strata movement monitoring and bed separation water drainage, comprising the following steps:

a. a rock strata movement monitoring borehole (1) and a bed separation water drainage borehole (2) are arranged along a central axis of a working face in a trending direction according to a mining width of the working face on a ground surface to be mined, wherein an interval between the rock strata movement monitoring borehole (1) and the bed separation water drainage borehole (2) is S;

b. a bottom interface of a bed separation (6) is acquired by geological drilling, and a development height $H_d$ of a diversion fissure zone (7) is determined according to mining conditions, or according to actually measured results in a same area; the rock strata movement monitoring borehole (1) is constructed, and then the bed separation water drainage borehole (2) is constructed, wherein a drilling depth of the rock strata movement monitoring borehole (1) is a buried depth $H_m$ of a top interface of a caving zone in a stratum, and a construction depth of the bed separation water drainage borehole (2) is 20 m above a buried depth $H_{dj}$ of a top interface of the diversion fissure zone, i.e. a buried depth $H_c$ of a coal seam subtracts the development height $H_d$ of the diversion fissure zone, and then subtracts 20 m;

c. distribution positions of n monitoring points are set according to stratum information obtained in advance, so as to correspond to movement states of strata at different depths, wherein monitoring points set above the bottom interface of the bed separation are monitoring points (11) on an upper part of the bed separation, a monitoring point between the bottom interface of the bed separation and the diversion fissure zone (7) is a bed separation development monitoring point (15), the diversion fissure zone (7) does not directly communicate with the bed separation (6), and monitoring points below the top interface of the diversion fissure zone (7) are lower monitoring points (10), a cable with the n monitoring points arranged at intervals is put at the buried depth $H_m$ inside the rock strata movement monitoring borehole (1) by utilizing a hollow grouting drill pipe (14), and positions of the n monitoring points are determined by utilizing a drill pipe depth, so that the n monitoring points are distributed at different borehole depths to monitor the movement states of the strata at the different depths;

d. cement slurry full hole sealing is performed from bottom to top starting from a most bottom of the rock strata movement monitoring borehole (1) by utilizing the hollow grouting drill pipe until cement slurry rises to a borehole orifice, so as to fix the positions of the n monitoring points, then the cable with the n monitoring points is connected with an orifice collector (12) set on the ground surface, and feedback information of the n monitoring points is read through the orifice collector (12) to monitor the movement state of each stratum in a mining process of the working face;

e. when the bed separation development monitoring point (15) in the rock strata movement monitoring borehole (1) starts to relatively move, the bed separation water drainage borehole (2) is continued to be constructed to penetrate through a bed separation accumulation area at a lower part of the bed separation to the buried depth $H_{dj}$ of the top interface of the diversion fissure zone, so that the bed separation water drainage borehole (2) communicates with the diversion fissure zone (7), and water is preliminarily drained to a lower rock fissure zone (9) and a caving area (8) through a fissure; when a movement speed difference of the stratum where the bed separation development monitoring point (15) is located exceeds 5 mm/d, the bed separation water drainage borehole (2) continues to be drilled from the top interface of the diversion fissure zone (7) to a deeper part of the fissure zone (9) until a half of a thickness of the diversion fissure zone (7), and a specific depth is $H_{dj}+(H_d-H_k)\div 2$; wherein $H_k$ presents a height of the caving zone;

when a relative movement speed of the stratum obtained from the bed separation development monitoring point (15) in the rock strata movement monitoring borehole (1) exceeds 10 mm/d, the bed separation water drainage borehole (2) continues to be drilled from a middle layer of the fissure zone (9) to the deeper part until a bottom of the fissure zone (9), i.e. the top interface of the caving zone (8) with the depth $H_m$; and during the period, the working face continues to be mined, through the above steps, according to development situation of stratum movement bed separation, bed separation water is discharged to the working face or a goaf area behind the working face in a staged and controlled manner and then drained by utilizing a drainage device;

f. as the working face advances, when the relative movement speed of the stratum obtained from the bed separation development monitoring point (15) in the rock strata movement monitoring borehole (1) does not change within 2-3 days, the relative movement speed of the stratum is considered to be in a temporary stable state, and then full borehole penetration is performed by an orifice of the bed separation water drainage borehole (2) until the fissure zone (9) is located on a vertically upward middle layer, so as to ensure smoothness of the bed separation water drainage borehole and play a role in continuous water release;

g. as the working face advances, according to monitoring information inside the rock strata movement monitoring borehole (1), when the relative movement speed of the stratum obtained from the bed separation development monitoring point (15) in the rock strata movement monitoring borehole (1) is less than 5 mm/d, and a movement difference between the top interface of the diversion fissure zone (7) and the bottom interface of the bed separation is continuously decreased within the next 5 days, a rock stratum at the lower part of the bed separation begins to be closed, the bed separation disappears gradually, then, the bed separation water drainage borehole (2) is made to penetrate through the bed separation water drainage borehole (2) to enable the bed separation water drainage borehole (2) to be unobstructed, and preparation is made for later hole sealing; and h. when the relative movement speed of the stratum obtained from the bed separation development monitoring point (15) in the rock strata movement monitoring borehole (1) is less than 1 mm/d, the cement slurry full hole sealing is performed on the bed separation water drainage borehole (2).

2. The ground double-hole combined water inrush prevention method for overlying strata movement monitoring and bed separation water drainage according to claim 1, wherein a coal seam thickness M and the buried depth $H_c$ of the coal seam around the rock strata movement monitoring borehole (1), a buried depth $H_s$ of a bottom interface of a water-rich bed separation mainly derived from the bed separation water to be prevented and lithology information of an overlying rock are acquired, so as to determine the development height $H_d$ of the diversion fissure zone (7) and the height $H_k$ of the caving zone of the stratum around the rock strata movement monitoring borehole (1), wherein the buried depth $H_{dj}$ of the top interface of the diversion fissure zone (7) is obtained by subtracting the development height $H_d$ of the diversion fissure zone (7) from the buried depth of the coal seam, and the buried depth $H_m$ of the top interface of the caving zone (8) is obtained by subtracting the height $H_k$ of the caving zone (8) from the buried depth $H_c$ of the coal seam, i.e. a construction depth of the rock strata movement monitoring borehole (1); that is, strata movement monitoring points are set inside the rock strata movement monitoring borehole (1), a final construction depth of the bed separation water drainage borehole (2) reaches the bottom interface of the diversion fissure zone, i.e. the buried depth $H_m$ of the top interface (6) of the caving zone.

3. The ground double-hole combined water inrush prevention method for overlying strata movement monitoring and bed separation water drainage according to claim 1, wherein a construction diameter of the rock strata movement monitoring borehole (1) needs to satisfy the following conditions: a borehole diameter $D_c$ required by strata movement monitoring is determined by an outer diameter m of the cable and a maximum outer diameter d of the hollow grouting drill pipe, $D_c$ is greater than or equal to the maximum outer diameter d of the hollow grouting drill pipe (14) used for hole sealing multiplied by 1.5 times plus a total number n of rock strata movement monitoring points multiplied by the outer diameter m of the cable m and multiplied by 60%, i.e. $D_c \geq d \times 1.5 + n \times m \times 60\%$, and a diameter of the bed separation water drainage borehole is 120-150 mm.

4. The ground double-hole combined water inrush prevention method for overlying strata movement monitoring and bed separation water drainage according to claim 1, wherein the interval S is greater than 10 m and less than or equal to 20 m, and the bed separation water drainage borehole (2) lags behind the rock strata movement monitoring borehole (1) in an advancing direction of the working face.

5. The ground double-hole combined water inrush prevention method for overlying strata movement monitoring and bed separation water drainage according to claim 1, wherein when the rock strata movement monitoring borehole (1) and the bed separation water drainage borehole (2) are constructed, a borehole slanting correction is conducted once every 50 m, and the borehole slanting correction is controlled not to be greater than 1 m every 100 m.

6. The ground double-hole combined water inrush prevention method for overlying strata movement monitoring and bed separation water drainage according to claim 1, wherein rock strata movement monitoring points are set inside the rock strata movement monitoring borehole, at least 2 monitoring points need to be set within the diversion fissure zone of the overlying strata, and at least 2 monitoring points are set between the top interface of the diversion fissure zone and a position above the bottom interface of a water-rich bed separation to be drained; and the number n of the rock strata movement monitoring points are at least greater than 5.

7. The ground double-hole combined water inrush prevention method for overlying strata movement monitoring and bed separation water drainage according to claim 1, wherein a movement speed difference of the rock strata movement monitoring points is calculated by dividing a movement difference of the rock strata movement monitoring points in unit time by the unit time, and the unit time generally selects half a day or 1 day.

8. The ground double-hole combined water inrush prevention method for overlying strata movement monitoring and bed separation water drainage according to claim 1, wherein the relative movement speed of the stratum obtained from the bed separation development monitoring point (15) in the rock strata movement monitoring borehole (1) is temporarily stable, which means that the relative movement speed does not change by more than 5 mm/d within 1 day temporarily.

9. The ground double-hole combined water inrush prevention method for overlying strata movement monitoring and bed separation water drainage according to claim 1, wherein the cement slurry used for the cement slurry full hole sealing is formed by mixing loose dry cement with water, the loose dry cement is ordinary Portland cement with a strength grade of 42.5R, and a water cement ratio in the cement slurry is 0.6:1.

* * * * *